US006029455A

United States Patent [19]

Sandelis

[11] Patent Number: 6,029,455

[45] Date of Patent: Feb. 29, 2000

[54] TURBOJET ENGINE COMBUSTION CHAMBER WITH HEAT PROTECTING LINING

[75] Inventor: Denis Sandelis, Nangis, France

[73] Assignee: Societe Nationale d'Etude et de Construction de Moteurs d'Aviation S.N.E.C.M.A., France

[21] Appl. No.: 08/919,353

[22] Filed: Aug. 28, 1997

[30] Foreign Application Priority Data

Sep. 5, 1996 [FR] France ..... 96 10824

[51] Int. Cl.[7] ..... F02C 1/00; F02G 3/00; F23R 3/06

[52] U.S. Cl. ..... 60/752; 60/755; 60/757; 60/758

[58] Field of Search ..... 60/39.31, 39.32, 60/752, 753, 757, 758, 754, 755, 756, 265

[56] References Cited

U.S. PATENT DOCUMENTS

| | | | |
|---|---|---|---|
| 3,965,066 | 6/1976 | Sterman et al. | 60/757 |
| 4,567,730 | 2/1986 | Scott | 60/755 |
| 4,622,821 | 11/1986 | Madden | 60/755 |
| 4,695,247 | 9/1987 | Enzaki et al. | 60/755 |
| 4,749,029 | 6/1988 | Becker et al. | 60/757 |
| 4,944,151 | 7/1990 | Hovnanian | 60/39.32 |
| 5,079,915 | 1/1992 | Veau | 60/753 |
| 5,528,904 | 6/1996 | Jones et al. | 60/757 |
| 5,598,697 | 2/1997 | Ambrogi et al. | 60/752 |
| 5,755,093 | 5/1998 | Palusis et al. | 60/266 |

FOREIGN PATENT DOCUMENTS

| | | |
|---|---|---|
| 0 224 817 | 11/1986 | European Pat. Off. . |
| 2 567 250 | 1/1986 | France . |
| 2 644 209 | 9/1990 | France . |
| 43 14 160 | 11/1993 | Germany . |
| 790292 | 2/1958 | United Kingdom . |
| 2 172 987 | 10/1986 | United Kingdom . |
| 2 298 266 | 8/1996 | United Kingdom . |
| 2 298 267 | 8/1996 | United Kingdom . |
| WO 92/16798 | 10/1992 | WIPO . |
| WO 96/04511 | 2/1996 | WIPO . |

*Primary Examiner*—Ted Kim
*Attorney, Agent, or Firm*—Bacon & Thomas PLLC

[57] ABSTRACT

A combustion chamber is disclosed for a turbojet engine in which the combustion chamber has a forward intake, a rear exit and a perforated casing extending between the intake and exit. The combustion chamber also has at least two rows of insulating tiles arrayed on the casing in forward and rear rows with both rows extending circumferentially around the inner surface of the casing bounding the combustion chamber. Each rear tile has a forward edge portion with a sloping wall and each forward tile has a tapered rear edge portion overlapping the forward edge portion with a clearance therebetween such that the tampered rear edge portion and the sloping wall bound a slot opening into the combustion chamber and slanting towards the rear of the combustion chamber to facilitate the formation of an air cooling film on inner surfaces of the tiles. The cooling air passes through the perforated casing, into the space between the casing and the tiles, through the clearance between the tiles and through the slot into the combustion chamber.

11 Claims, 4 Drawing Sheets

TURBOJET ENGINE COMBUSTION CHAMBER WITH HEAT PROTECTING LINING

BACKGROUND OF THE INVENTION

The present invention relates to a combustion chamber for an aircraft turbojet engine having a heat protecting lining on the interior of the wall bounding the combustion chamber. The lining comprises a plurality of insulating tiles having a unique juncture to avoid large thermal gradients along the length of the combustion chamber, the juncture also facilitating the formation of a cooling air layer along the inner surfaces of the tiles.

Turbojet engines for civilian and military aircraft have ever increasing power outputs. One of the many factors involved in such increased output has been the higher compression ratios of the intake air. One of the results of the use of such higher compression ratios has been the increase in gas temperatures both at the compressor outlet and within the confines of the combustion chamber. In order to preserve the structural integrity of the combustion chambers, means must be utilized to protect the walls bounding the combustion chambers. However, the amount of air used to establish cooling films on the inner surfaces of the combustion chamber walls must be kept to a minimum in order to maintain the efficiency of the engine.

It is known to utilize insulating tiles in the combustion chamber to minimize the heat transfer between the gases within the combustion chamber and the wall bounding the combustion chamber. French Patent 2,567,250 and British Patent 2,172,987 disclose combustion chamber configurations in which the combustion chamber has a structural wall extending between the intake and the outlet of the combustion chamber with annular rings of insulating material spaced from the inner surface of the wall between the wall and the combustion chamber. The junctures of the longitudinally adjacent insulating ring define outlets through which cooling air passes to establish a cooling film on the inner surface of the insulating rings. While generally successful, these configurations form rather steep thermal gradients between longitudinally adjacent insulating rings.

French Patent 2,644,209 describes a protective lining for an afterburner duct which comprises a plurality of tiles affixed to and spaced from the duct. A seal is interposed between longitudinally adjacent rows of tiles.

SUMMARY OF THE INVENTION

A combustion chamber is disclosed for a turbojet engine in which the combustion chamber has a forward intake, a rear exit and a perforated casing extending between the intake and exit. The combustion chamber also has at least two rows of insulating tiles arrayed on the casing in forward and rear rows with both rows extending circumferentially around the inner surface of the casing bounding the combustion chamber. Each rear tile has a forward edge portion with a sloping wall and each forward tile has a tapered rear edge portion overlapping the forward edge portion with a clearance therebetween such that the tapered rear edge portion and the sloping wall bound a slot opening into the combustion chamber and slanting towards the rear of the combustion chamber to facilitate the formation of an air cooling film on inner surfaces of the tiles. The cooling air passes through the perforated casing, into the space between the casing and the tiles, through the clearance between the tiles and through the slot into the combustion chamber.

The present invention provides a thermally protective lining cooperating with the combustion chamber casing and defining a combustion zone, wherein the lining comprises a plurality of juxtaposed tiles forming rings which are mounted end-to-end from the forward end of the combustion chamber towards the rear exit. The rings, together with the combustion chamber casing, bound annular spaces in which cooling air from the outside of the combustion chamber circulates to form a cooling film after passing between the juncture of the rows of tiles.

The combustion chamber is characterized in that the insulating tiles are connected by means of raised surfaces to the combustion chamber casing. The rear edge portion of the forward tiles is tapered and is located adjacent to a sloping wall of a forward portion of the rear tiles so as to form a sloping slot therebetween. The slot communicates, via a clearance between the forward portion of the rear tile and the rear portion of the forward tile, with the space between the casing and the tile to enable air from externally of the combustion chamber wall to form a cooling film on the inner surfaces of the tiles. The raised surfaces of the tiles bear against the combustion chamber wall and facilitates the attachment of the tiles to the combustion chamber casing by means of rivets or the like.

In a first embodiment, the rear edge portion forms a tapered surface to form one bounding surface of the sloping slot. In a second embodiment, the rear edge portion of the forward tile forms a generally "U"-shaped channel opening towards the rear of the combustion chamber into which is placed a forward protrusion extending forwardly from the forward edge portion of the rear tile with a clearance being maintained between the protrusion and the walls bounding the channel. Spacers may be mounted on the forward protrusion to bear against the wall bounding the channel so as to maintain the clearance between these elements. Air from outside the combustion chamber wall passes into the "U"-shaped channel, around the forward protrusion, and through the sloped slot so as to form an insulating film on the inner surfaces on the tiles.

DETAILED DESCRIPTION OF THE PREFERRED EMBODIMENTS

Figure 1:
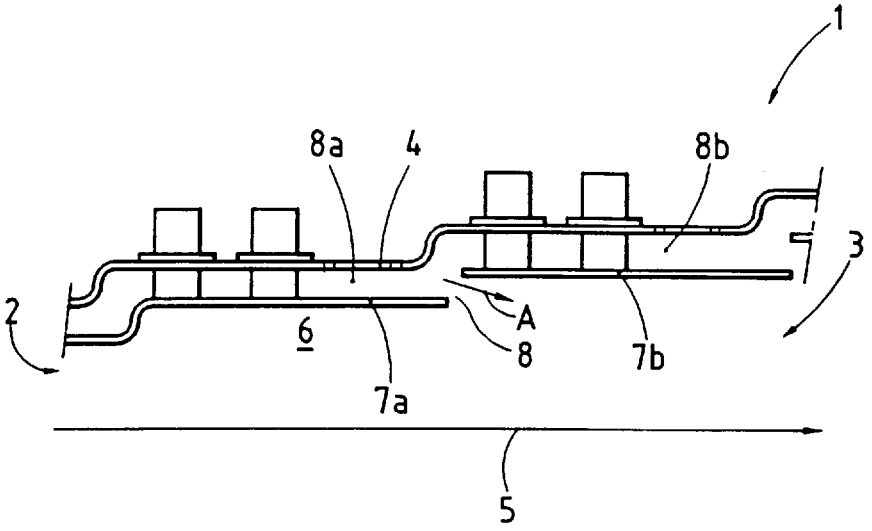
FIG.1 PRIOR ART
FIG. 1 is a partial, longitudinal cross-sectional view illustrating a known combustion chamber wall having insulating tiles.

FIG. 1 illustrates a known gas turbine engine combustion chamber having an intake 2 on the forward end, which receives air and fuel to be burned, an exit 3 at the rear end to evacuate the combustion products toward a high pressure turbine (not shown) and a perforated casing 4 extending between the intake 2 and the exit 3 which forms the outer boundary of the combustion chamber. The combustion chamber 1 may either be annular in configuration, or may be tubular in configuration as are well known in the art. Reference numeral 5 illustrates the direction of gas flow within the combustion zone 6 of the combustion chamber. The casing 4 is lined on its inner surface facing the combustion zone 6 with a plurality of rings 7*a,* 7*b* mounted end-to-end along the length of the combustion chamber in the direction of the arrow 5. Each of the plurality of rings 7*a,* 7*b* comprise a plurality of juxtaposed insulating tiles. Adjacent rings 7*a*, 7*b* are radially spaced to form steps along the length of the combustion zone 6 with the spaces 8 between the adjacent ring edges communicating with annular spaces 8*a* and 8*b* between each of the rings 7*a* and 7*b* and the casing 4. Cooling air A passes through the perforations 4*a* in the casing 4 into the annular spaces 8*a*, 8*b*, and through the spaces 8 to form a cooling film on the inner surfaces of the ring around the periphery of the combustion zone 6.

Figure 2:
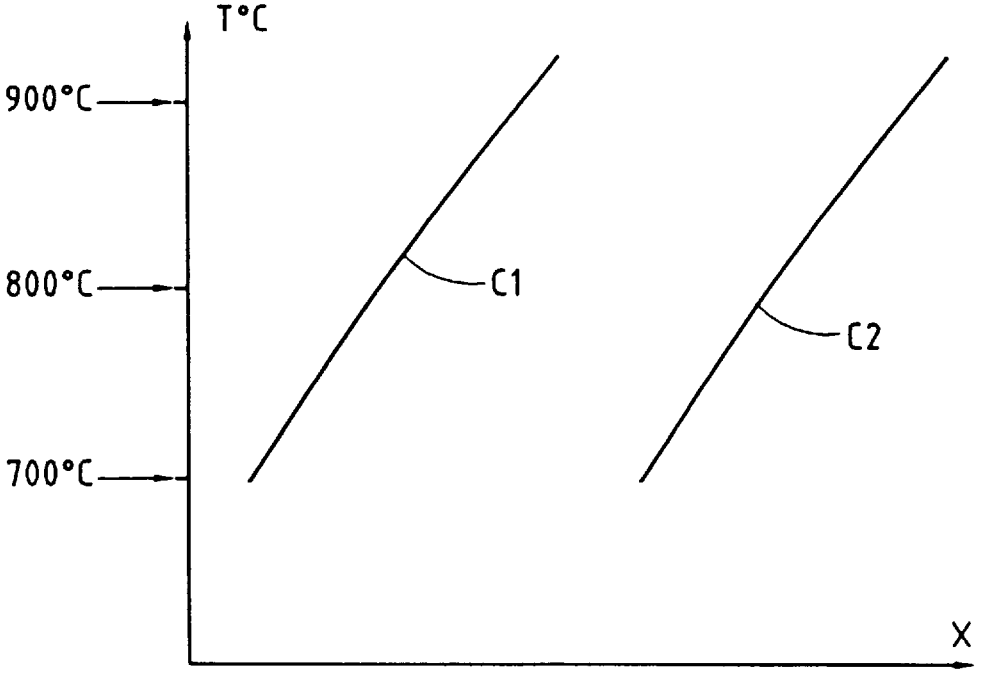
FIG.2 PRIOR ART
FIG. 2 is a graph illustrating the temperatures on the insulating tiles along the axial length of the combustion chamber illustrated in FIG. 1.

FIG. 2 is a graph of the temperatures of the rings along the axial length (X) of the combustion chamber, curve C1 illustrating the temperatures axially along ring 7*a* and curve C2 illustrating the temperatures axially along the ring 7*b*. As can be seen, the juncture between the two rings exhibits a very high thermal gradient in the region of the spaces 8.

Figure 3:
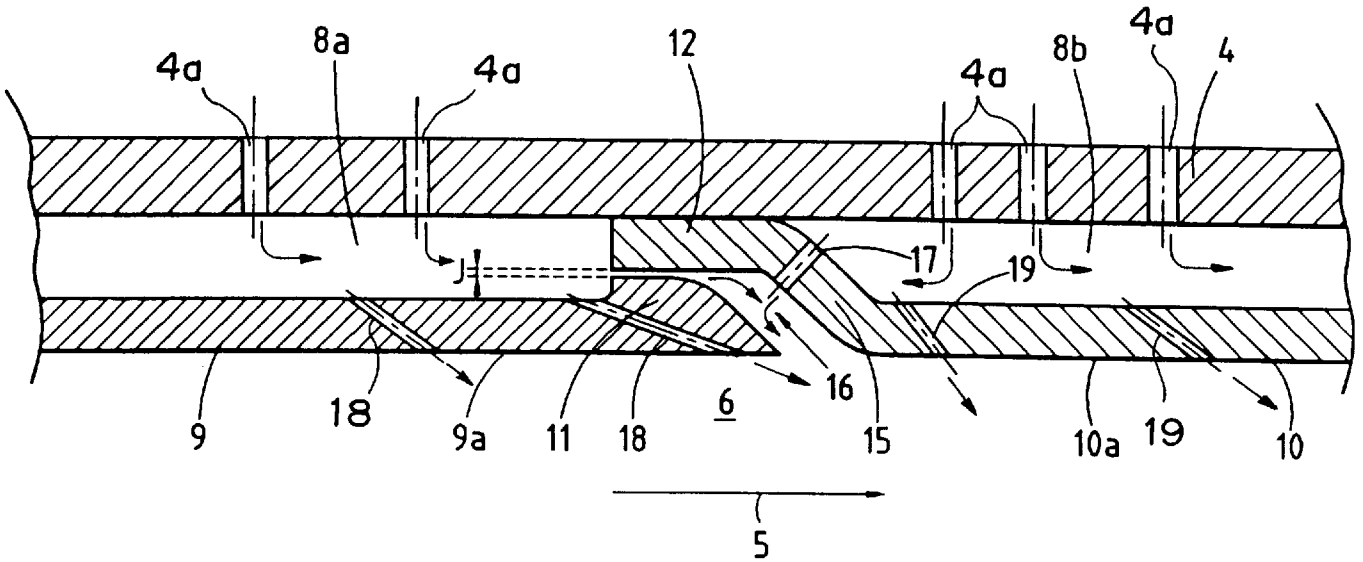
FIG. 3 is a partial, cross-sectional view of a first embodiment of the present invention illustrating a juncture between the forward and rear tiles.
Figure 4:
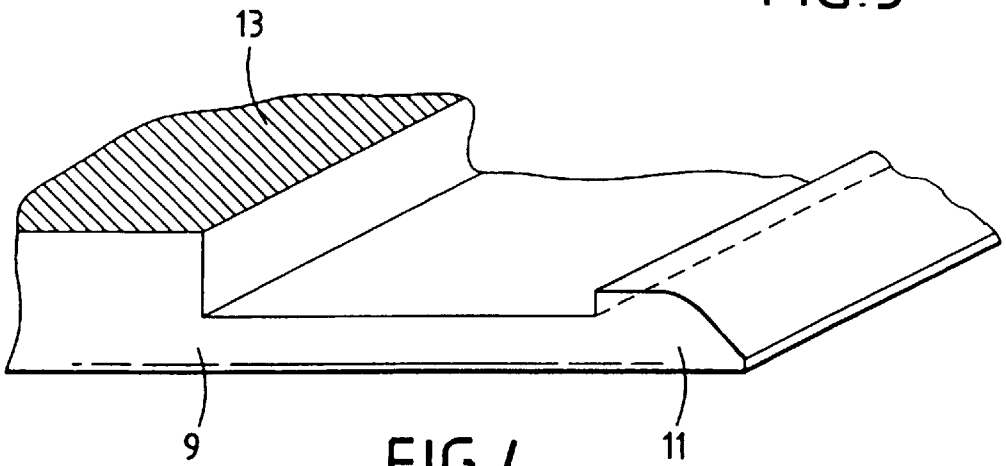
FIG. 4 is a partial, perspective view of a rear edge portion of a forward tile according to the present invention.
Figure 5:
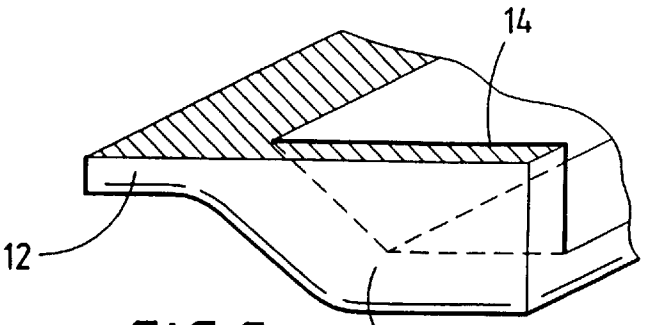
FIG. 5 is a partial, perspective view of a forward portion of a rear tile according to the present invention.

FIGS. 3–5 illustrate a first embodiment of the present invention. A plurality of forward tiles 9 having inner surfaces 9*a* are circumferentially arranged around the combustion chamber to form the forward ring, while a plurality of rear tiles 10 having inner surfaces 10*a* are circumferentially arranged around the combustion chamber and form a rear insulating tile ring. The forward tiles 9 have a rear edge portion 11 with a tapered surface. The rear tiles 10 have a forward edge portion 12 with a sloping wall 15. As can be seen in FIG. 3, the rear portion 11 of the forward tile 9 overlaps the forward portion 12 of the rear tile 10 such that the tapered surface and the sloping wall bound an inwardly and rearwardly sloping slot 16. A clearance J is maintained between the rear portion 11 and the forward portion 12 enabling the slot to communicate with the space 8*a* maintained between the forward tile 9 and the casing 4.

Insulating tiles 9 and 10 also have, on their outer surfaces, raised surface portions 13 and 14 which surface portions are in contact with the outer casing 4, thereby forming the spaces 8*a* and 8*b* between the respective tiles and the casing 4. As is well known in the art, casing 4 has a multiplicity of perforations 4*a* enabling air from the outside of the casing to pass through the casing into the spaces 8*a* and 8*b*. The clearance J is preferably between 0.1 and 0.2 mm and enables cooling air from the annular space 8*a* to flow into the sloped slot 16. This cooling air enables convection cooling of the rear edge portion 11 of the forward tile 9 and of the forward edge portion 12 of the rear tile 10. A plurality of orifices 17 extend through the sloping wall 15 of the tile 10 in communication with space 8*b* to impact cool the rear tapered edge portion 11 of the forward tile 9. Multiple orifices 18 are also present in the rear edge portion 11 of the tile 9 to enhance the heat exchange in the rear edge portion. The orifices 18, as illustrated in FIG. 3, communicate between the interior of the combustion chamber and the annular space 8*a*, and are slanted inwardly towards the rear exit of the combustion chamber. Similarly, slanted multiple orifices 19 extend through the tile 10 through the inner surface 10*a* of the tiles so as to communicate between the annular space 8*b* and the interior of the combustion chamber. The air passing through the orifices 19 enhance the heat exchange of the forward edge portion of the tiles 10.

Tiles 9 and 10 are fixedly attached to the casing 4 by rivets. The raised surfaces 13 and 14 are dimensioned to define the clearance J when they are in tight contact with the casing following the attachment of the tiles to the casing.

Figure 6:
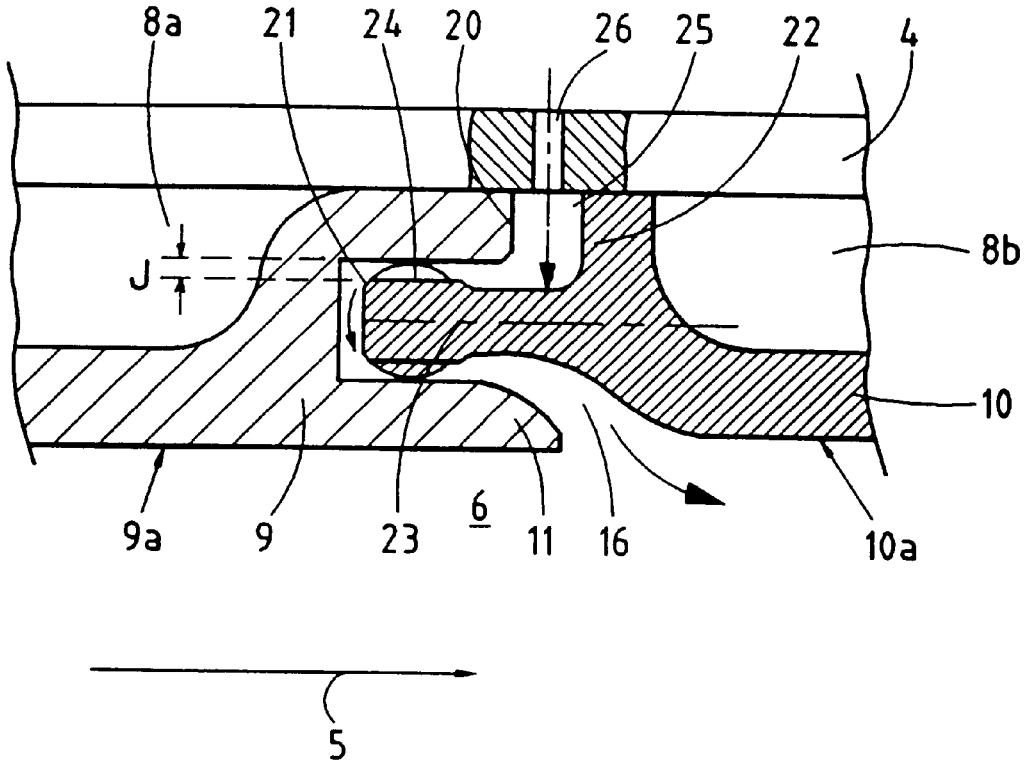
FIG. 6 is a partial, cross-sectional view of a second embodiment the present invention illustrating the juncture between the forward and rear tiles.

A second embodiment of the present invention is illustrated in FIG. 6. In this embodiment, a forward protrusion 23 extends forwardly from the forward edge portion of the rear tiles 10 and is received in a channel 21 formed in the rear edge portion of the forward tiles 9. Again, the sloping wall of the rear tile 10 and the tapered surface of the rear edge portion 11 define a slot 16 communicating with the interior of combustion chamber and sloping rearwardly towards the rear portion of the casing. The slot 16 communicates with the channel 21 through the clearance maintained between the forward protrusion 23 and the walls bounding the channel 21. A rear radial surface 20 of the forward tile 9 is spaced forwardly of a forward radial surface 22 formed on the rear tile 10, which space 25 communicates with orifice 26 formed in the casing 4. This enables cooling air to pass through their orifice 26, space 25, and the clearance maintained between the protrusion 23 and the walls bounding the channel 21, and into the space 16 from which it forms a cooling film on the inner surface 10*a* of the tiles 10. The clearance J may be maintained between the forward protrusion 23 and the walls bounding the channel 21 by a plurality of spacers 24 formed on the protrusion 23 which bear against the opposite walls bounding the "U"-shaped channel 21. These spacers may be in the form of circular beads, or the like.

In the second embodiment of the invention, the rear edge portion of the forward tile 9 and the forward edge portion of the rear tile 10 may also define orifices 17–19 as in the previous embodiment.

Figure 7:
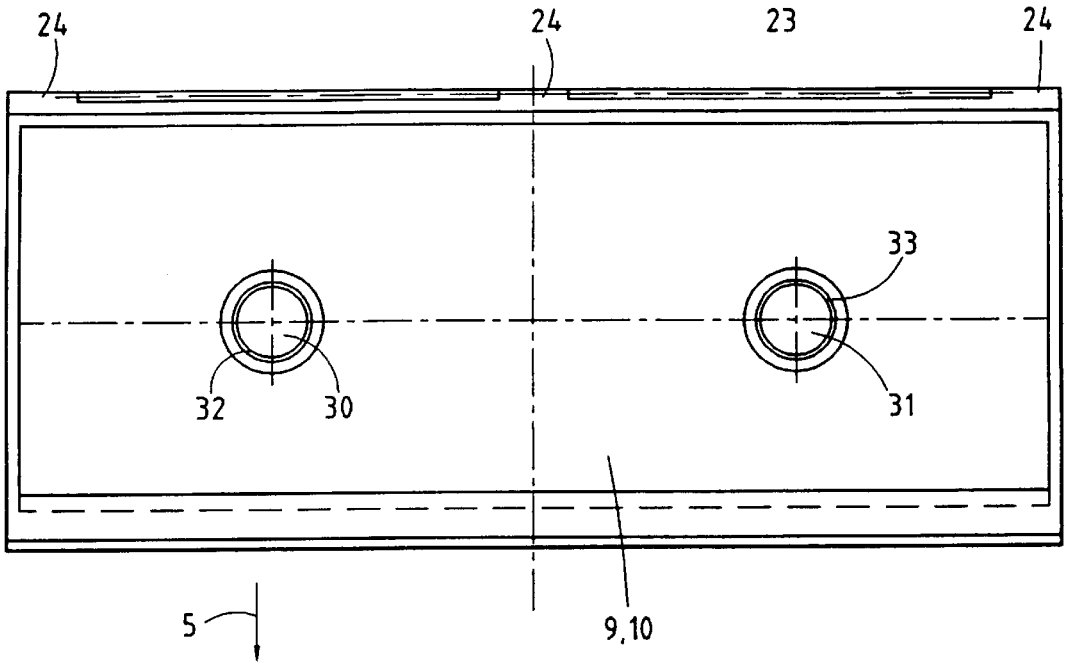
FIG. 7 is a top view of a tile according to the present invention.
Figure 8:
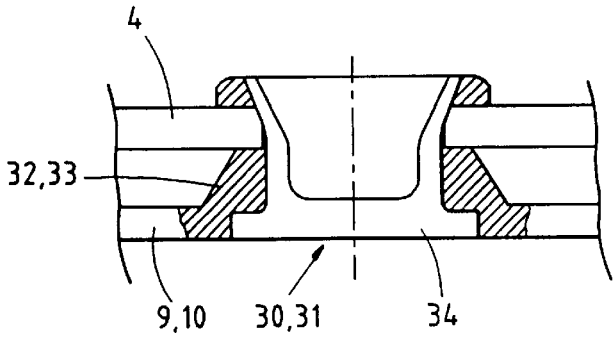
FIG. 8 is a partial, cross-sectional view illustrating the attachment between the tile and the combustion chamber casing.

FIGS. 7 and 8 illustrate tiles 9, 10 having holes 30, 31 surrounded by raised surfaces 32, 33, respectively, in order to enable the tiles 9, 10 to be affixed to the casing 4 by rivets 34. The upper sides of the raised surfaces 32, 33 as well as the raised surfaces on the tiles 9 and 10 will bear against the casing 4 following their attachment. The tiles 9, 10 are attached to the casing 4 such that their inner surfaces 9*a*, 10*a* are substantially coplanar along the length of the combustion chamber.

The inventive configuration of the tiles 9, 10 avoids the presence of the steep thermal radiance between the tiles as in the known prior art configurations. This improves the surface life of the combustion chamber structure while preserving the advantages of the multi-perforation cooling. The invention also enables the improvement of the temperature profile at the outlet of the combustion chamber, thereby reducing the thermal stresses induced on the turbine.

The foregoing description is provided for illustrative purposes only and should note be construed as in any way limited this invention, the scope of which is defined solely by the appended claims.

I claim:

1. A combustion chamber for a turbojet engine, the combustion chamber comprising:

a forward intake;

a rear exit;

at least one perforated casing between the forward intake and the rear exit; and a thermally protective lining cooperating with the combustion chamber and defining a combustion zone, the lining comprising at least two rows of tiles juxtaposed to form rings such that the two rows extend circumferentially around the combustion chamber in a forward row and a rear row, the forward and rear rows having inner surfaces which are substantially coplanar, the forward and rear rows being a plurality of forward and rear tiles, respectively, the rear tiles in the rear row having forward edge portions with walls which slope away from the inner surfaces and subsequently extend forwardly along the perforated wall, the forward tiles in the forward row having raised surface portions on outer surfaces thereof which are in contact with the perforated casing so as to form a space between the forward tiles and the perforated casing and having tapering rear edge portions which taper toward the inner surfaces and which overlap the forward edge portions with a clearance "J" therebetween, the clearance "J" being arranged to communicate with the space between the forward tiles and the perforated casing, the tapered rear edge portions of the forward tiles being located adjacent the walls of the forward edge portions of the rear tiles so as to bound a slot having a width therebetween, the slot opening into the combustion chamber so as to communicate between the clearance "J" and the combustion chamber and slanting rearwardly such that cooling air passing from the space, through the clearance and through the slot forms a cooling film on the inner surface of the rear row of tiles, the clearance "J" being substantially smaller than the width of the slot.

2. The combustion chamber of claim 1, wherein the forward and rear tiles are fixedly attached to the casing.

3. The combustion chamber of claim 2, wherein the tiles are fixedly attached to the casing by rivets.

4. A combustion chamber for a turbojet engine, the combustion chamber comprising:

a forward intake;

a rear exit;

at least one perforated casing between the forward intake and the rear exit; and a thermally protective lining cooperating with the combustion chamber and defining a combustion zone, the lining comprising at least two rows of tiles juxtaposed to form rings such that the two rows extend circumferentially around the combustion chamber in a forward row and a rear row, the forward and rear rows having inner surfaces which are substantially coplanar and parallel to a centerline of the combustion chamber, the forward and rear rows being a plurality of forward and rear tiles, respectively, the rear tiles in the rear row having forward edge portions with walls which slope away from the inner surfaces and subsequently extend forwardly along the perforated wall, the forward tiles in the forward row having raised surface portions on outer surfaces thereof which are in contact with the perforated casing so as to form a space between the forward tiles and the perforated casing and having tapering rear edge portions which taper toward the inner surfaces and which overlap the forward edge portions with a clearance "J" therebetween, the clearance "J" being arranged to communicate with the space between the forward tiles and the perforated casing, the tapered rear edge portions of the forward tiles being located adjacent the walls of the forward edge portions of the rear tiles so as to bound a slot having a width therebetween, the slot opening into the combustion chamber so as to communicate between the clearance and the combustion chamber and slanting rearwardly such that cooling air passing from the space, through the clearance "J" and through the slot forms a cooling film on the inner surface of the rear row of tiles, the clearance "J" being substantially smaller than the width of the slot.

5. The combustion chamber of claim 4, wherein the forward and rear tiles are fixedly attached to the casing.

6. The combustion chamber of claim 5, wherein the tiles are fixedly attached to the casing by rivets.

7. A combustion chamber for a turbojet engine, the combustion chamber comprising:

a forward intake;

a rear exit;

at least one perforated casing between the forward intake and the rear exit; and a thermally protective lining cooperating with the combustion chamber and defining a combustion zone, the lining comprising at least two rows of tiles juxtaposed to form rings such that the two rows extend circumferentially around the combustion chamber in a forward row and a rear row, the forward and rear rows having inner surfaces which are substantially coplanar, the forward and rear rows being a plurality of forward and rear tiles, respectively, the rear tiles in the rear row having forward edge portions with sloping walls which slope away from the inner surfaces, the forward tiles in the forward row having raised surface portions on outer surfaces thereof which are in contact with the perforated casing so as to form a space between the forward tiles and the perforated casing and having U-shaped rear portions having outer legs contacting the perforated casing and inner legs forming tapering rear edge portions which taper toward the inner surfaces, at least one of the legs overlapping the forward edge portions with a clearance "J" therebetween, the clearance "J" being arranged to communicate with a source of air outside the perforated casing, the tapered rear edge portions of the forward tiles being located adjacent the walls of the forward edge portions of the rear tiles so as to bound a slot having a width therebetween, the slot opening into the combustion chamber so as to communicate between the clearance "J" and the combustion chamber and slanting rearwardly such that cooling air passing through the clearance and through the slot forms a cooling film on the inner surface of the rear row of tiles, the clearance "J" being substantially smaller than the width of the slot.

8. The combustion chamber of claim 7, further comprising:

a) a channel formed in the U-shaped rear edge portion of each forward tile, the channel having a generally "U"-shaped cross-sectional configuration opening rearwardly; and b) a forward protrusion extending forwardly from the forward edge portion of each rear tile and into the channel such that the clearance "J" is formed between the forward protrusion and the channel.

9. The combustion chamber of claim 8, further comprising: at least one spacer located on the forward protrusion and bearing against a surface bounding the channel.

10. The combustion chamber of claim 7, wherein the forward and rear tiles are fixedly attached to the casing.

11. The combustion chamber of claim 10, wherein the tiles are fixedly attached to the casing by rivets.

* * * * *